US005499664A

United States Patent [19]

Figiel et al.

[11] Patent Number: 5,499,664

[45] Date of Patent: Mar. 19, 1996

[54] COMPRESSIVE CUTTING MECHANISM HAVING PLURAL-EDGED CUTTER

[75] Inventors: Janusz Figiel, Mount Prospect; Peter Drabarek, Chicago, both of Ill.

[73] Assignee: Illinois Tool Works Inc., Glenview, Ill.

[21] Appl. No.: 206,848

[22] Filed: Mar. 7, 1994

[51] Int. Cl.[6] ..... B21F 11/00

[52] U.S. Cl. ..... 140/152; 83/955

[58] Field of Search ..... 140/93.2, 93.4, 140/93.6, 152; 83/658, 697, 699.11, 955

[56] References Cited

U.S. PATENT DOCUMENTS

| | | | |
|---|---|---|---|
| 1,971,021 | 8/1934 | Spoor | 140/93.6 |
| 2,801,558 | 8/1957 | Crosby et al. | 140/152 |
| 3,998,429 | 12/1976 | Cheung | 254/79 |
| 4,505,304 | 3/1985 | Zust | 83/658 |
| 4,646,601 | 3/1987 | Borzym | 83/385 |
| 4,825,512 | 5/1989 | Tremper et al. | 24/20 |
| 4,928,738 | 5/1990 | Marelin et al. | 140/93.4 |
| 4,949,615 | 8/1990 | Jordan | 83/955 |
| 5,140,882 | 8/1992 | Hyder | 83/620 |
| 5,203,541 | 4/1993 | Nix | 254/218 |

OTHER PUBLICATIONS

Operation, Parts and Safety Manual—Signode—SMC-12/58/34 "Combination Strapping Tool".

Operation, Parts and Safety Manual—Signode-SLC-38/12/58/34 "Manual Combination Strapping Tool for General Duty Strap Only".

*Primary Examiner*—Lowell A. Larson

*Attorney, Agent, or Firm*—Donald J. Breh; Thomas W. Buckman; John P. O'Brien

[57] ABSTRACT

A cutting mechanism is disclosed, which is useful in a strapping tool of the type used to apply a steel strap in a tensioned loop around a package by means of a series of interlocking joints comprising interlockable shoulders punched into overlapped ends of the strap. The cutting mechanism comprises an anvil arranged to support the overlapped ends of such a strap, a cutter holder movable toward and away from the anvil, an elongate cutter removably mounted within to the holder so as to extend crosswise in relation to the overlapped ends such a strap when the overlapped ends of such a strap are supported by the anvil. The cutter is movable conjointly with the holder, toward and away from the anvil. The cutter has a polygonal profile defining plural, elongate, parallel cutting edges, one of which projects toward the anvil when the cutter is mounted within the holder. The cutter, which is removable from the holder when the cutting edge projecting toward the anvil becomes dull, is remountable within the holder such that another one of the cutting edges projects toward the anvil. The cutter profile may be triangular, preferably equilateral, or quadrilateral, preferably rhombic or square. An equilateral, triangular profile is most preferred. The cutting mechanism has other utility, apart from a strapping tool of the type noted above.

20 Claims, 2 Drawing Sheets

Fig. 3
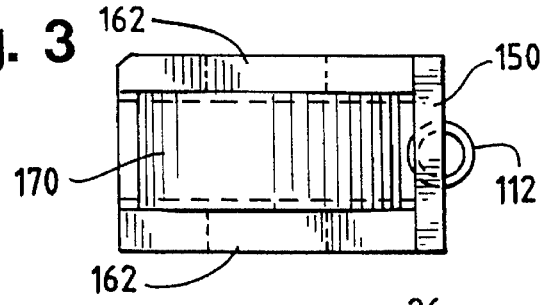
Fig. 4
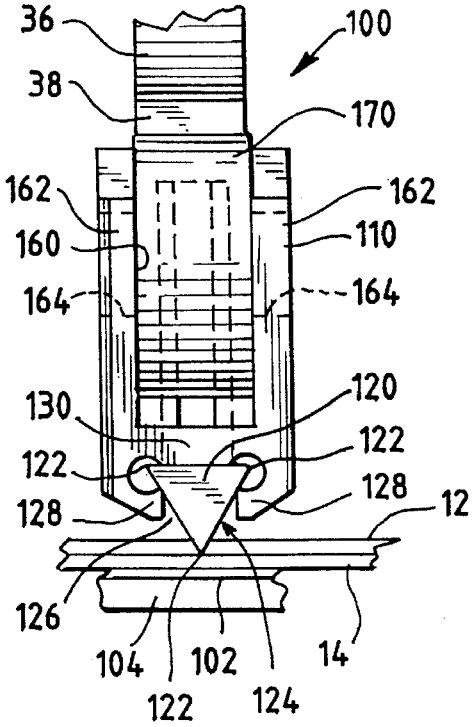
Fig. 5
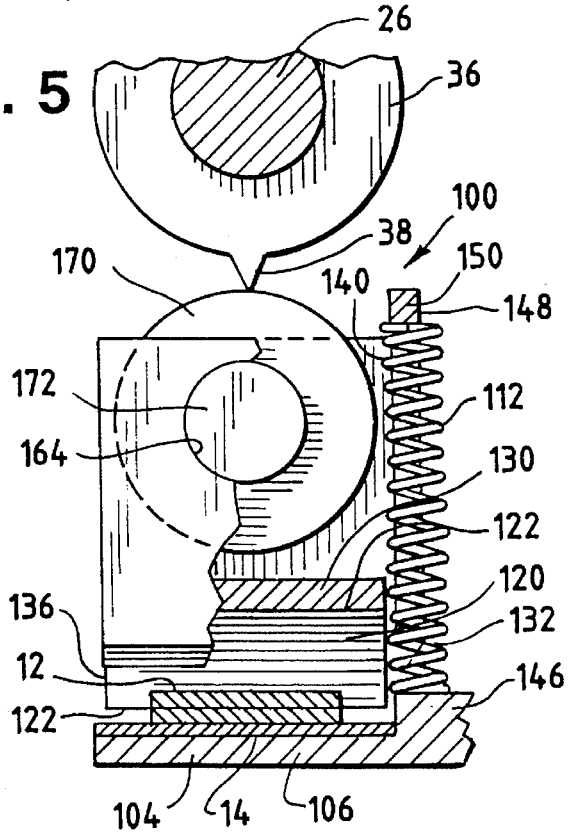
Fig. 7
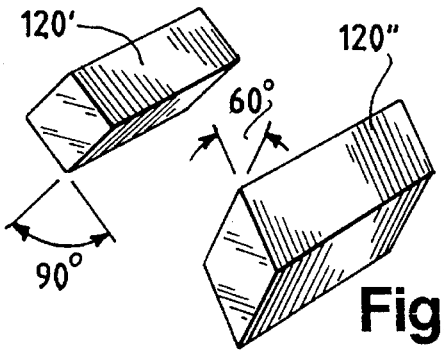
Fig. 8
Fig. 6
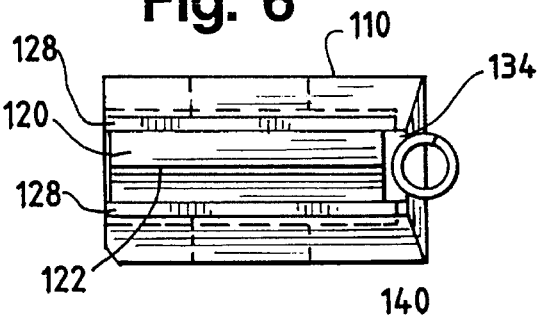

COMPRESSIVE CUTTING MECHANISM HAVING PLURAL-EDGED CUTTER

TECHNICAL FIELD OF THE INVENTION

This invention pertains to a cutting mechanism which is useful particularly but not exclusively in a strapping tool of the type used to apply a steel strap in a tensioned loop around a package by means of a series of interlocking joints comprising interlockable shoulders punched into two overlapped ends of the strap. In the cutting mechanism, a cutter having plural cutting edges is mounted upon a holder and is movable with the holder, toward and away from an anvil. This invention contemplates that the cutter is removable from the holder when one of the plural cutting edges becomes dull and is remountable to then permit another cutting edge to be used.

BACKGROUND OF THE INVENTION

One version of a strapping tool of the type noted above is disclosed in Cheung U.S. Pat. No. 3,998,429. Certain aspects of a later version of such a manual strapping tool are disclosed in Nix U.S. Pat. No. 5,203,541. Different aspects of another, more recent version of such a strapping tool are disclosed in two patent applications filed contemporaneously on Oct. 8, 1993, under U.S. patent application Ser. No. 08/133,284 and U.S. patent application Ser. No. 08/133,290 respectively, and assigned commonly herewith.

Tremper U.S. Pat. No. 4,825,512 provides a useful example of a steel strap having a series of interlocking joints formed by interlockable shoulders punched into its overlapped ends.

Generally, a strapping tool of the type noted above comprises an actuating handle, which is arranged to be manually oscillated. The actuating handle rotates an output shaft, which actuates a series of cams, by means of an input shaft, to which the actuating handle is coupled, and by means of intermediate gears. Several of the cams drive punches, which punch interlockable shoulders into two overlapped ends of a steel strap.

One of the cams drives a cutter, which compressively cuts through the outer one of the overlapped ends of the applied strap, so as to desirably cut any excess strap from the applied strap without cutting into the inner one of the overlapped ends. An anvil supports the overlapped ends of the strap as the cutter compressively cuts through the outer one of the overlapped ends. Conventionally, the cutter has been provided with one cutting edge, which eventually becomes dull. Generally, it is inconvenient to resharpen the cutting edge or to replace the cutter, which heretofore has been an expensive component.

Manual strapping tools of the type noted above are available commercially from Signode Industry Packaging Systems (a unit of Illinois Tool Works Inc.) of Glenview, Ill., under its SIGNODE trademark. One such commercially available tool (SIGNODE Model SMC-12/58/34 Combination Strapping Tool) includes a removable cutter, which has a single blade, and which is designed to slide into and out from a recess in a cutter holder so as to facilitate replacement of the removable cutter.

SUMMARY OF THE INVENTION

This invention provides a cutting mechanism that is useful particularly but not exclusively in a strapping tool of the type noted above. In such a strapping tool, the cutting mechanism is used for compressively cutting through the outer one of two overlapped ends of a steel strap, as the overlapped ends are supported by an anvil. It is envisioned that the cutting mechanism may have other uses, as in a wire cutting tool, a tree-pruning tool, or some other tool for compressively cutting a workpiece.

Generally, the cutting mechanism comprises an anvil arranged to support the workpiece, a cutter holder movable toward and away from the anvil, and an elongate cutter removably mounted upon to the holder and movable conjointly with the holder, toward and away from the anvil. In a strapping tool of the type noted above, the anvil is arranged to support the overlapped ends of such a strap when the overlapped ends are supported by the anvil, and the cutter is removably mounted upon to the holder so as to extend crosswise in relation to the overlapped ends of such a strap when such ends are supported by the anvil.

The cutter has plural, elongate, parallel cutting edges. One of the cutting edges projects toward the anvil when the cutter is mounted upon the holder. The cutter is removable from the holder when the cutting edge projecting toward the anvil becomes dull and is remountable upon the holder such that another one of the cutting edges projects toward the anvil.

In a preferred arrangement, the holder has an elongate recess having an open end and has an elongate slot opening from the elongate recess, toward the anvil, and defining two opposed edges for retaining the cutter. Moreover, the cutter is configured to fit lengthwise into the recess when the cutter is mounted upon the holder. Furthermore, one of the cutting edges protrudes through the slot and projects toward the anvil when the cutter is mounted within the slot.

Preferably, the cutter has a polygonal profile. More preferably, the cutter profile may be triangular, possibly equilateral, or quadrilateral, possibly rhombic or square. An equilateral, triangular profile is most preferred, because it provides three cutting edges defining acute (60°) angles, which are desirable for cutting steel strap with a cutter made from hardened tool steel.

BRIEF DESCRIPTION OF THE DRAWINGS

These and other objects, features, and advantages of this invention will become evident from the following description of a preferred embodiment of this invention with reference to the accompanying drawings in which like reference characters designate like or corresponding parts throughout the several views, and wherein:

FIG. 3, on a further enlarged scale, is a top plan view of the cutter holder, the elongate cutter, and the other elements shown in FIG. 2, except for the biasing spring, which is hidden.

FIG. 4 is a front elevation view of the cutter holder, the elongate cutter, and the other elements shown in FIG. 2. A cam coacting therewith, two overlapped ends of a steel strap, an anvil supporting the overlapped ends of the strap, and a stepped portion of a base plate are shown fragmentarily.

FIG. 5 is a partly fragmentary, side elevation view of the cutter holder, the elongate cutter, and the other elements shown in FIG. 4.

FIG. 6 is a bottom plan view of the cutter holder and the elongate cutter.

FIGS. 7 and 8 are perspective views of two alternative cutters, which respectively have a square profile and a rhombic profile.

DETAILED DESCRIPTION OF PREFERRED EMBODIMENT

Figure 1:
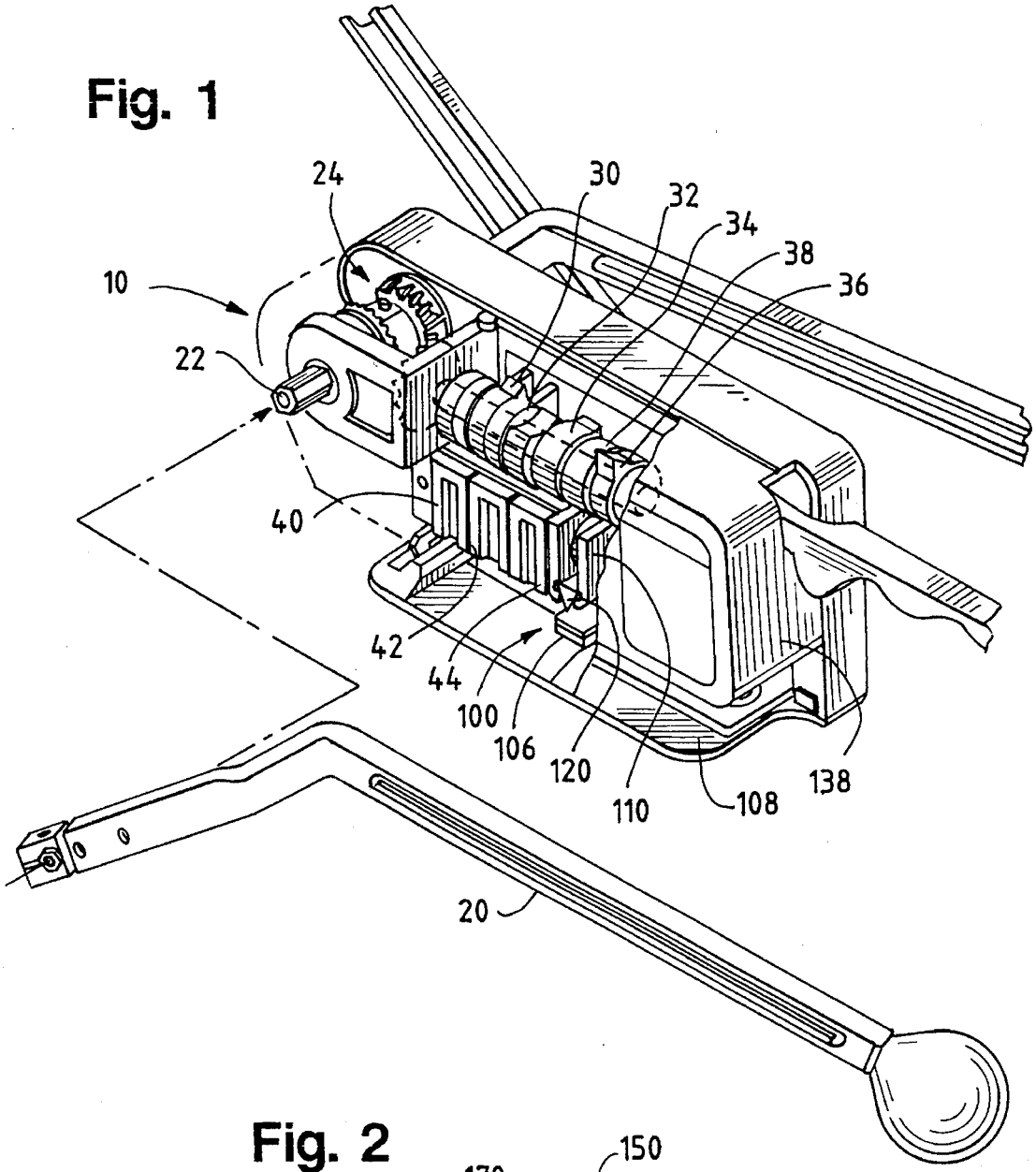
FIG. 1 is a fragmentary, partly exploded, perspective view of a strapping tool of the type noted above. The strapping tool incorporates a cutting mechanism constituting a preferred embodiment of this invention.
Figure 2:
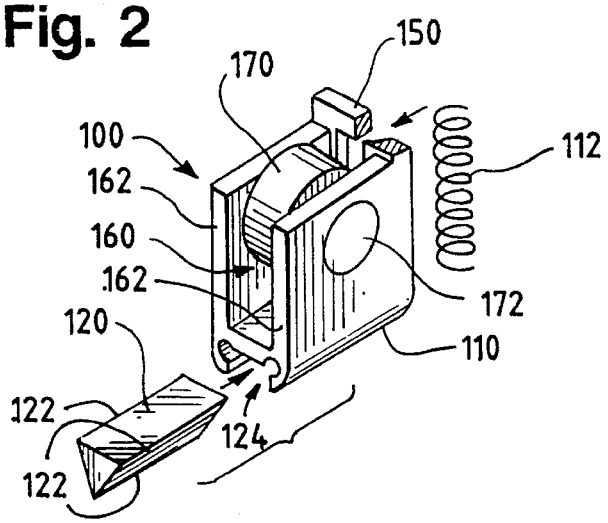
FIG. 2, on an enlarged scale, is an exploded, perspective view of a cutter holder, an elongate cutter having an equilateral, triangular profile, a roller, a shaft for the roller, and a biasing spring, as employed in the cutting mechanism.

As shown in FIG. 1, a strapping tool 10 is used to apply a steel strap in a tensioned loop around a package by means of a series of interlocking joints comprising interlockable shoulders punched into two overlapped ends of the strap. The strapping tool 10 incorporates a cutting mechanism 100 constituting a preferred embodiment of this invention.

As shown in FIGS. 4 and 5, in which the overlapped ends of a steel strap being applied around a package (not shown) are shown fragmentarily, the cutting mechanism 100 is used for compressively cutting through the outer end 12 of the steel strap being applied, so as to cut any excess strap from the steel strap being applied without cutting the inner end 14 of the steel strap being applied.

Except for the cutting mechanism 100, the strapping tool 10 is similar to the strapping tool disclosed in U.S. patent application Ser. No. 08/133,284 and U.S. patent application Ser. No. 08/133,290 noted above, the disclosures of which are incorporated herein by reference.

The strapping tool 10 comprises an actuating handle 20, which is coupled to an input shaft 22, and which is arranged to be manually oscillated so as to impart oscillatory rotation to the input shaft 22. As disclosed in U.S. patent application Ser. No. 08/133,290, oscillatory rotation of the input shaft 22 is converted to unidirectional rotation of an output shaft 26, by means of a set of bevel gears 24. Four cams 30, 32, 34, 36, are coupled to the output shaft 26 so as to rotate conjointly with the output shaft 26.

The cams 30, 32, 34, drive three punches 40, 42, 44, which punch interlockable shoulders into the overlapped ends 12, 14, of the steel strap being applied. Dies (not shown) coacting with the punches 40, 42, 44, underlie the overlapped ends 12, 14, of the steel strap being applied. The cam 36, which has a single lobe 38, is used to actuate the cutting mechanism 100.

The cutting mechanism 100 comprises an anvil 102, which is mounted on a lower step 104 of a stepped platform 106 fixed to or formed on a base plate 108 of the strapping tool 10. The anvil 102 supports the overlapped ends 12, 14, of the steel strap as the outer end 12 is compressively cut.

The cutting mechanism 100 comprises a cutter holder 110, which is mounted within the strapping tool 10 so as to be vertically movable within a limited range of vertical movement, and an elongate cutter 120, which is removably mounted to the cutter holder 110. Thus, the cutter holder 110 and the elongate cutter 120 are movable toward and away from the anvil 102. The cutting mechanism 100 comprises a biasing spring 112, which is made from coiled wire, and which is arranged to bias the cutter holder 110 and the elongate cutter 120 away from the anvil 102.

As shown in FIGS. 2, 4, 5, and 6, the elongate cutter 120 is machined from tool steel so as to have an equilateral triangular profile providing three parallel cutting edges 122 defining acute (60°) angles as determined by the intersection of the three planar surfaces of the cutter 120. As shown in FIGS. 2 through 6, the cutter holder 110 is machined so as to have an elongate recess 124 having an open end defining an elongate slot 126 opening downwardly from the elongate recess 124, toward the anvil 102, and defining two opposed edges 128 as well as an upper wall 130 wherein the wall 130 and the edges 128 respectively engage the planar surfaces of the cutter 120. The elongate cutter 120 is configured to fit lengthwise into the elongate recess 124 so that one of the cutting edges 122 protrudes downwardly through the elongate slot 126, between the opposed edges 128, when the elongate cutter 120 is mounted upon or within the cutter holder 110 while the other two cutting edges 122, which are not disposed in the cutting position, are disposed within recessed portions 129 of the cutter holder 110 such that such inoperative cutting edges 122 are not prematurely marred, scratched, nicked, or otherwise dulled prior to their intended cutting use.

When the elongate cutter 120 is mounted upon or within the cutter holder 110, the opposed edges 128 retain the elongate cutter 120 so that the elongate cutter 120 cannot drop from the elongate recess 124, through the cutter holder 110 defining the elongate slot 126. Also, the upper wall 130 of the elongate recess 124 and the opposed edges 128 coact so as to prevent the elongate cutter 120 from rotating within the elongate recess 124. Further, a rearward end 132 of the elongate cutter 120 is retained by a rear stop 134, which is an integral part of the elongate cutter 120. At the open end 126 of the elongate recess 124, a forward end 136 of the elongate cutter 120 is retained by a cover 138 (see FIG. 1) of the strapping tool 10. The cover 138 is removable to provide access to the cutter holder 110 and to the elongate cutter 120.

As shown in FIGS. 2, 3, 5, and 6, the cutter holder 110 is machined so as to define a semi-cylindrical recess 140, which opens rearwardly and downwardly, and in which a biasing spring 112 is disposed. A lower end 144 of the biasing spring 112 bears against an upper step 146 of the stepped platform 106. An upper end 148 of the biasing spring 112 bears against a cross portion 150 of the cutter holder 110. The biasing spring 112 is compressed so as to bias the cutter holder 110 and the elongate cutter 120 upwardly away from the anvil 102. As shown in FIGS. 2 through 6, the cutter holder 110 is machined so as to define a roller-accommodating recess 160 between two side walls 162. Each side wall 162 has a circular aperture 164, which is aligned axially with the circular aperture of the other wall 162. A roller 170 is rotatably mounted within the roller-accommodating recess 160, by means of a shaft 172 received by the circular apertures 164 in the side walls 162, so as to extend partly above the side walls 162. The biasing spring 112 biases the cutter holder 110 and the elongate cutter 120 upwardly so that the roller 170 bears against and coacts with the cam 36 having the single lobe 38. Except when the cam 36 is rotated so that the single lobe 38 begins to engage the roller 170, the cam 36 permits the cutter holder 110 and the elongate cutter 120 to move upwardly away from the anvil 102, as biased by the biasing spring 112. When the cam 36 is rotated so that the single lobe 38 begins to engage the roller 170, the single lobe 38 cams the roller 170 downwardly so as to drive the cutter holder 110 and the elongate cutter 120 downwardly toward the anvil 102, as opposed by the biasing spring 112.

As shown in FIGS. 4 and 5, when the cutter holder 110 and the elongate cutter 120 are driven downwardly by the single lobe 38 of the cam 36, the cutting edge 122 projecting downwardly toward the anvil 102 compressively cuts the outer end 12 of the steel strap without cutting the inner end 14 thereof, as the overlapped ends 12, 14, are supported by the anvil 102. Once the single lobe 38 of the cam 36 has passed the roller 170, the biasing spring 140 moves the cutter holder 110 and the elongate cutter 120 upwardly away from the anvil 102, and away from the severed end 12 of the steel strap.

When the cutting edge 122 projecting downwardly becomes dull after extended use of the strapping tool 10, the cover 138 is removed to provide access to the cutter holder 110 and to the elongate cutter 120. The elongate cutter 120 may then be removed from the cutter holder 110, rotated so that another cutting edge 122 projects downwardly, and remounted within the cutter holder 110. There is no need, therefore, to replace the elongate cutter 120 until all three edges 122 have become dull.

As shown in FIGS. 2, 4, 5, and 6, the elongate cutter 120 is machined so as to have an equilateral triangular profile, which provides three cutting edges 122 defining acute (60°) angles. As shown in FIG. 7, an elongate cutter 120' machined from tool steel so as to have a square profile providing four cutting edges defining right (90°) angles may be alternatively used, if a cutter holder (not shown) having a suitably configured slot to mount elongate cutter 120' but being similar to the cutter holder 110 in other respects is provided. As shown in FIG. 8, an elongate cutter 120" machined from tool steel so as to have a rhombic profile providing two cutting edges defining acute (60°) angles and two other edges defining obtuse (120°) angles may be alternatively used, if a cutter holder (not shown) having a suitably configured slot to mount the elongate cutter 120" and being similar to the cutter holder 110 in other respects is provided.

Various other modifications may be made in the preferred embodiment described above without departing from the scope and spirit of this invention as defined by means of the appended claims. It is therefore to be understood that within the scope of the appended claims, the present invention may be practiced otherwise than as specifically described herein.

We claim:

1. A cutting mechanism for compressively cutting a workpiece, comprising:

an anvil for supporting a workpiece;

a cutter holder movable toward and away from said anvil;

an elongate cutter removably mounted upon said cutter holder so as to be movable conjointly with said cutter holder toward and away from said anvil, and having a polygonal cross-sectional configuration comprising a plurality of surfaces disposed at predetermined angles with respect to each other so as to define a plurality of elongate, parallel cutting edges at intersection loci of said surfaces, wherein one of said cutting edges projects toward said anvil when said cutter is mounted within said cutter holder, said cutter being removable from said holder when said cutting edge projecting toward said anvil becomes dull and being remountable within said cutter holder such that another one of said plurality of cutting edges projects toward said anvil; and mounting means defined upon said cutter holder for engaging said surfaces of said cutter, and recess means defined within said cutter holder for accommodating those cutting edges of said cutter, which do not project toward said anvil and are not being used at a predetermined time for a cutting operation, in such a manner that said cutting edges not being used for a cutting operation are free from contact with said cutter holder such that said cutter holder does not prematurely dull said cutting edges, not being used for a cutting operation, prior to their use in cutting operations.

2. The cutting mechanism of claim 1 wherein the holder has an elongate recess with an elongate slot opening toward the anvil and defining two opposed edges retaining the cutter when the cutter is mounted upon the holder, and wherein the cutter is configured to fit lengthwise into the recess with one of the cutting edges protruding through the slot and projecting toward the anvil when the cutter is mounted upon the holder.

3. The cutting mechanism of claim 1 wherein the cutter profile is triangular.

4. The cutting mechanism of claim 3 wherein the cutter profile is equilateral.

5. The cutting mechanism of claim 1 wherein the cutter profile is quadrilateral.

6. The cutting mechanism of claim 5 wherein the cutter profile is rhombic.

7. The cutting mechanism of claim 5 wherein the cutter profile is square.

8. The cutting mechanism as set forth in claim 1, further comprising:

means for biasing said cutter holder and said cutter mounted thereon away from said anvil; and means for moving said cutter holder and said cutter mounted thereon toward said anvil so as to enable said cutting edge projecting toward said anvil to cut the outer one of said overlapped ends of said strap when said overlapped ends of said strap are supported upon said anvil.

9. The cutting mechanism as set forth in claim 8, wherein:

said means for biasing said cutter holder and said cutter mounted thereon away from said anvil comprises a coil spring.

10. The cutting mechanism as set forth in claim 9, wherein said means for moving said cutter holder and said cutter mounted thereon toward said anvil comprises:

a roller rotatably mounted within said cutter holder; and a rotary cam, having a cam lobe provided upon a peripheral portion thereof, disposed above said roller;

said coil spring biasing said cutter holder, and said cutter mounted thereon, upwardly toward said rotary cam such that said roller rotatably engages said rotary cam whereupon engagement of said roller by said cam lobe of said rotary cam, said roller, said cutter holder, and said cutter mounted thereon, are moved downwardly against the biasing force of said biasing spring so as to cause said cutter to compressively engage and cut said outer one of said overlapped ends of said strap.

11. A strapping tool of the type used to apply a steel strap in a tensioned loop around a package by means of a series of interlocking joints comprising interlockable shoulders punched into overlapped ends of said strap, and including a cutting mechanism arranged to compressively cut an outer one of said overlapped ends of said strap, comprising:

an anvil for supporting said overlapped ends of said strap;

a cutter holder movable toward and away from said anvil;

an elongate cutter removably mounted upon said cutter holder so as to extend crosswise in relation to said overlapped ends of said strap when said overlapped ends of said strap are supported upon said anvil, and having a polygonal cross-sectional configuration comprising a plurality of surfaces disposed at predetermined angles with respect to each other so as to define a plurality of elongate, parallel cutting edges at intersection loci of said surfaces, wherein one of said cutting edges projects toward said anvil when said cutter is mounted within said cutter holder, said cutter being removable from said cutter holder when said cutting edge projecting toward said anvil becomes dull and being remountable within said cutter holder such that another one of said plurality of cutting edges projects toward said anvil; and mounting means defined upon said cutter holder for engaging said surfaces of said cutter, and recess means defined within said cutter holder for accommodating those cutting edges of said cutter, which do not project toward said anvil and are not being used at a predetermined time for a cutting operation, in such a manner that said cutting edges not being used for a cutting operation are free from contact with said cutter holder such that said cutter holder does not prematurely dull said cutting edges, not being used for a cutting operation, prior to their use in cutting operations.

12. The cutting mechanism of claim 11, further comprising:

means for biasing said cutter holder and said cutter mounted thereon away from said anvil; and means for moving said cutter holder and said cutter mounted thereon toward said anvil so as to enable said cutting edge projecting toward said anvil to cut the outer one of said overlapped ends of said strap when said overlapped ends of said strap are supported upon said anvil.

13. The cutting mechanism as set forth in claim 12, wherein:

said means for biasing said cutter holder and said cutter mounted thereon away from said anvil comprises a coil spring.

14. The cutting mechanism of claim 12 wherein the holder has an elongate recess with an elongate slot opening toward the anvil and defining two opposed edges retaining the cutter when the cutter is mounted upon the holder, and wherein the cutter is configured to fit lengthwise into the recess with one of the cutting edges protruding through the slot and projecting toward the anvil when the cutter is mounted upon the holder.

15. The cutting mechanism as set forth in claim 14, wherein said means for moving said cutter holder and said cutter mounted thereon toward said anvil, comprises:

a roller rotatably mounted within said cutter holder; and a rotary cam, having a cam lobe provided upon a peripheral portion thereof, disposed above said roller;

said coil spring biasing said cutter holder, and said cutter mounted thereon, upwardly toward said rotary cam such that said roller rotatably engages said rotary cam whereupon engagement of said roller by said cam lobe of said rotary cam, said roller, said cutter holder, and said cutter mounted thereon, are moved downwardly against the biasing force of said biasing spring so as to cause said cutter to compressively engage said outer one of said overlapped ends of said strap.

16. The cutting mechanism of claim 11 wherein the cutter profile is triangular.

17. The cutting mechanism of claim 16 wherein the cutter profile is equilateral.

18. The cutting mechanism of claim 11 wherein the cutter profile is quadrilateral.

19. The cutting mechanism of claim 18 wherein the cutter profile is rhombic.

20. The cutting mechanism of claim 18 wherein the cutter profile is square.

* * * * *